United States Patent [19]

Maser et al.

[11] Patent Number: 4,827,551

[45] Date of Patent: May 9, 1989

[54] ELECTRICAL DEVICE FOR MOUTH CARE

[76] Inventors: Brigitte Maser, Hohenzollerndamm 50, D-1000 Berlin 33; Gerhard David, Kurfürstendamm 48, D-1000 Berlin 15, both of Fed. Rep. of Germany

[21] Appl. No.: 171,037

[22] Filed: Mar. 21, 1988

[51] Int. Cl.[4] ..... A46B 13/04

[52] U.S. Cl. ..... 15/24; 15/97 R; 123/56; 123/62 A

[58] Field of Search ..... 15/22 R, 22 A, 22 C, 15/23, 24, 28, 29, 97 R, 110, 4; 128/56, 62 A; 433/125, 131, 132, 114

[56] References Cited

U.S. PATENT DOCUMENTS

| | | | |
|---|---|---|---|
| 2,134,934 | 11/1938 | Wilhoit | 15/23 |
| 2,435,421 | 3/1948 | Blair | 15/23 |
| 3,258,802 | 7/1966 | Rodriguez | 15/23 |

FOREIGN PATENT DOCUMENTS

| | | | |
|---|---|---|---|
| 1137754 | 1/1957 | France | 15/23 |
| 472657 | 6/1952 | Italy | 15/23 |
| 297994 | 10/1928 | United Kingdom | 128/62 A |
| 86/02813 | 5/1986 | World Int. Prop. O. | 15/24 |

*Primary Examiner*—Edward L. Roberts
*Attorney, Agent, or Firm*—Arnold S. Weintraub; William D. Blackman

[57] ABSTRACT

An electrical base powers an attached massaging head and toothbrush. Water flows through the base into the massaging head to stimulate the gums and clean the teeth.

9 Claims, 2 Drawing Sheets

ELECTRICAL DEVICE FOR MOUTH CARE

BACKGROUND OF THE INVENTION

1. Field of the Invention:

This invention relates to an electrical device for mouth care with a movably supported part. Such devices have hitherto only been used as electric toothbrushes.

2. Prior Art:

As is known to those skilled in the art to which the present invention pertains, the electrical devices for mouth care have been limited to either a water-pick or an electric toothbrush. In the past there has been no combined device which incorporates the use of water flow through a device to serve both as a gum stimulator and toothbrush. The electrical mouth care device of the present invention combines the advantage of water flow through a device used for gun stimulation with a brushing device for tooth care to facilitate more effective and convenient care of the teeth and gums.

SUMMARY OF THE INVENTION

The present invention defines an electrical, battery powered device which drives a connected massage head and/or toothbrush to move in a rotary direction, while circulating water through the device to the massage head for the purpose of stimulating the gums and cleaning the teeth.

The massage head basically comprises a longitudinal connecting tube which mates with a smaller tube projecting from the base of the device, the tubes allowing water to flow through the base portion of the device into the massage head and out through an opening in the massage head. The massage head itself is constructed from a rubber or rubber-like material the surface and shape of which insures the intense massaging of the gums. The massage head may be of various designs comprising variations in the surface texture of the massage head. The massage head comprises an irregular surface having various patterns of projections or protuberances, to provide maximum stimulation of the gums and cleaning of the teeth. The device is battery operated, but may be charged from an electrical outlet as well. The electrical portion of the device contains an off/on switch for the motor and a gear which drives the massage heads. Also contained on the base of the device is an off/on switch to control the water supply through the device turning the water supply on or off. The device is an improvement over the prior art in that it fills the dual purpose of a water driven, gum stimulating, electrical device and an electric toothbrush.

IN THE DRAWINGS

DETAILED DESCRIPTION OF THE PREFERRED EMBODIMENTS

The electric device for mouth care generally comprises two main sections, the lower section which serves as a handle and houses the electrical mechanism, and the upper section which comprises the massaging heads or the combination massaging head-toothbrush.

Figure 1:
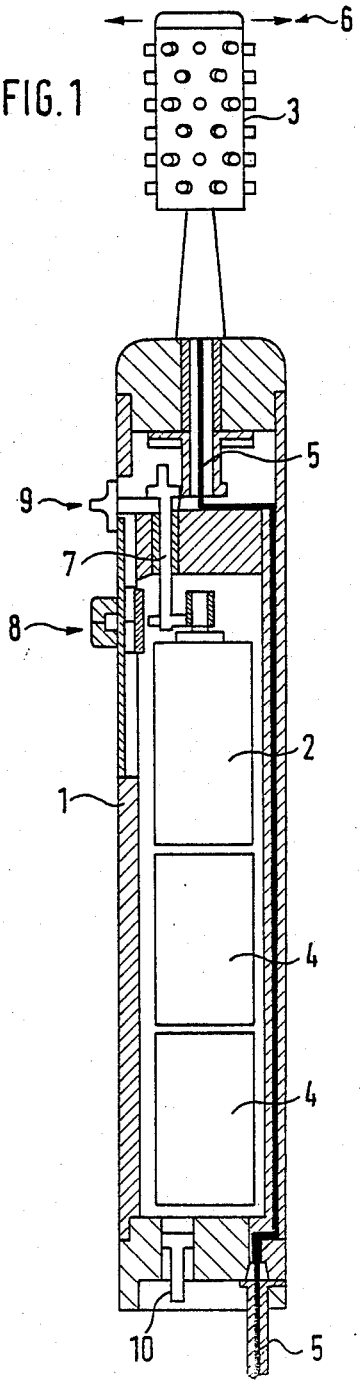
FIG. 1 shows an elevated sectional view of an electrical device with a massage head, having protuberances.

FIG. 1 shows the complete electrical device 1 wherein the motor 2 that drives the massage head is located in the base of the device. The motor 2 can impart to the massage head a rotary movement. The device is powered by a rechargeable battery 4, located in the base of the device. Located at the bottom of the base is an electrical charging connector 10, which connects to a recharging device powered by an electrical outlet. A water pipe or tube 5 projects from the base of the device where it connects to a water supply. The tube then extends running through the length of the base of the device, into the tube which connects with the massage head. Water then flows out through a passage way in the massage head. A switch located on the base of the device controls the flow of water through the device, turning the water on or off. Also, the motor may be turned off or on by means of a switch located on the base of the device. A gear, 7, located between the motor 2 and the massage head 3 *a*, allows the motor to drive the massage head.

Figure 2:
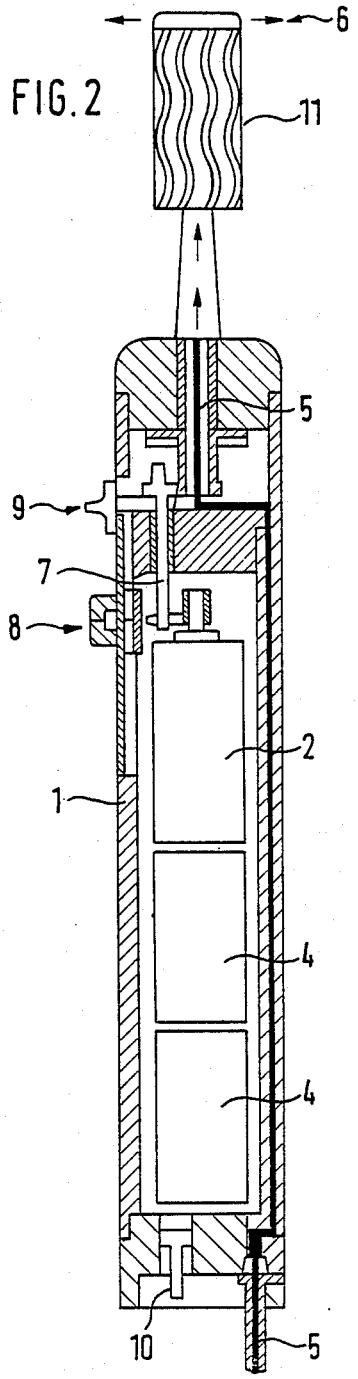
FIG. 2 shows an electrical device with a variation in the design of the massage head, the massage head having vertical wavy projections.
Figure 3:
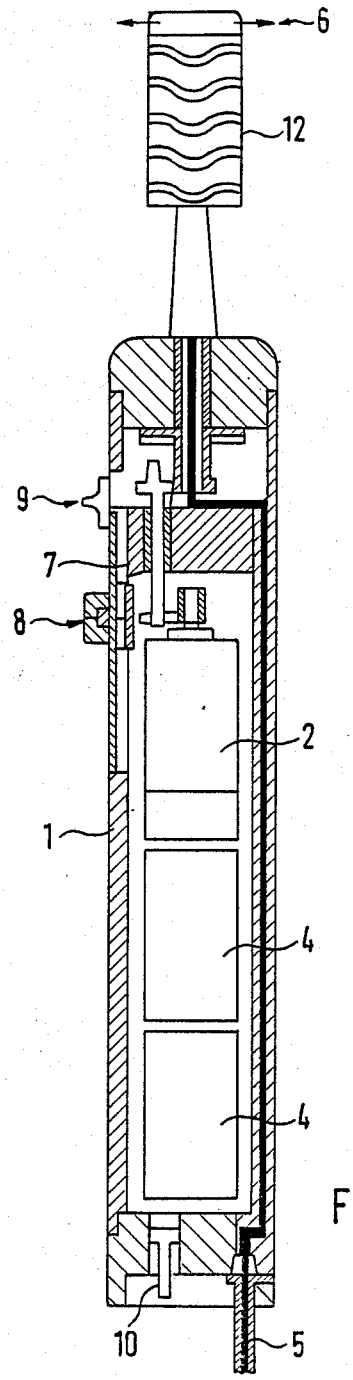
FIG. 3 shows the device with a varying design of massage head, the massage head having horizontally wavy projections.
Figure 4:
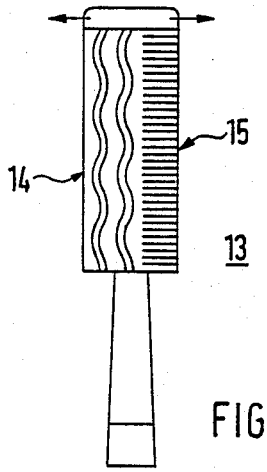
FIG. 4 shows the massage head provided with both massaging and bristle regions.

The massage head 3, which can be of varying designs can be attached to the base of the device. The massage head is attached to the base of the device by means of a tubular projection to allow the insertion of an attachment tube projecting from the base of the device, as well as allowing water flow therethrough. The massage head itself is made from a rubber or rubber-like material, preferably plastic, and its shape ensures intense massaging of the gums. Massage action is achieved by the design of the massage head 3 which has an irregular surface. Massage head designs include projecting barb-like bulges or protuberances as shown in FIG. 1. An alternative design is shown in FIG. 2, which depicts a massage head having wavy, projecting, massaging surface, which run in the axial direction of the cylindrical massage head. Yet another alternative massage head design is shown in FIG. 3, wherein the massaging region of the massage head 12 is provided with wavy bulges running in the circumferential direction. As shown in FIG. 4, yet another alternative massage head 13 is axially sub-divided into two sections: a first section 14 is made from rubber or a rubber-like material with axially directed wavy bulges for massaging the gums and a second section 15 is constructed as a brush used for cleaning the teeth. The axially sub-divided massage head provides a means for both massaging the gums and cleaning the teeth on the same head.

We claim:

1. An electrical device for mouth care comprising a lower base section and a movably supported upper part, the lower base portion containing an electrical driving mechanism for the device and the upper portion characterized in that it has a massage head for the purpose of contacting the gums and teeth, the device also supplying water flow through the device to the surface of the gums and teeth by its flow through the massage head, the massage head having massaging regions containing a resilient rubber-like material, the massaging regions having projections extending outwardly therefrom, the projections formed from the resilient rubber-like material.

2. The device of claim 1, wherein the electrical power source is supplied by means of batteries located in the base of the device, the batteries being of a rechargeable nature.

3. The device of claim 2, further comprising:

an electrical connection located on the base of the device by means of which the batteries may be recharged.

4. The device of claim 3 further comprising a gear which is driven by the motor which in turn drives the massage head causing the head to move in a rotary direction.

5. The device of claim 4 wherein the massaging head that attaches to the base of the device comprises an irregular surface for the purpose of massaging of gums, as well as a hollow portion on the inside of the massaging head to allow the flow of water therethrough and a hollow passageway at the uppermost portion of the massaging head to allow the flow of water out from the inside of the massaging head.

6. The device of claim 15 wherein an irregular surface pattern comprises wavy projecting, massaging surface which run in the axial direction of the cylindrical massage head.

7. The device of claim 5 wherein the massage regions comprised projecting barb-like bulges or protuberances.

8. The device of claim 5 wherein the massaging region comprised wavy bulges running in the circumferential direction.

9. The massaging head of claim 5 wherein the head is axially sub-divided into two sections, the first section comprising an irregular surface and the second section comprising a brush used for cleaning your teeth.

* * * * *